US006063270A

United States Patent [19]

d'Offay

[11] Patent Number: 6,063,270

[45] Date of Patent: May 16, 2000

[54] SWIMMING POOL SKIMMING DEVICE

[76] Inventor: Robert André d'Offay, 3 Ravel Road, Walmer Heights, Port Elizabeth, South Africa

[21] Appl. No.: 09/150,103

[22] Filed: Sep. 9, 1998

[30] Foreign Application Priority Data

Sep. 10, 1997 [ZA] South Africa ..... 97/8136

[51] Int. Cl.[7] ..... E04H 3/16

[52] U.S. Cl. ..... 210/169; 210/232; 210/242.1; 210/416.2; 210/460; 4/492; 4/496

[58] Field of Search ..... 210/169, 232, 210/242.1, 241, 416.2, 460, 459; 4/492, 496, 507, 509

[56] References Cited

U.S. PATENT DOCUMENTS 2,982,971 5/1961 Garaway .
2,989,185 6/1961 Lombardi .
3,578,023 5/1971 Simsbury et al. .
4,613,169 9/1986 Engelhart .
4,647,374 3/1987 Ziaylek et al. .
4,746,424 5/1988 Drew .
5,040,250 8/1991 Barnes et al. .
5,536,397 7/1996 D'Offay .

*Primary Examiner*—David A. Simmons
*Assistant Examiner*—Fred Prince
*Attorney, Agent, or Firm*—Townsend and Townsend and Crew LLP

[57] ABSTRACT

A swimming pool skimming device for skimming leaves and other floating debris from the water surface. The device includes a conduit and a connector for connecting one end of the conduit to the return flow inlet of the pool. The device also includes a trap support unit to which the other end of the conduit is connected. The unit has a shroud extending beneath the second end of the conduit and there is a porous trap which is supported by the trap support unit with the second end of the conduit spaced apart from and aimed at the trap. The trap support unit is sufficiently buoyant to support the second end of the conduit and the trap near the water surface. In use a return water flow from the return flow inlet passes through the conduit and is directed through water at the surface of the pool towards the trap. Floating matter at the surface of the water in the swimming pool is entrained in the flow and is captured in the trap.

6 Claims, 2 Drawing Sheets

SWIMMING POOL SKIMMING DEVICE

BACKGROUND TO THE INVENTION

1. Field of the Invention

This invention relates to a swimming pool skimming device.

2. Description of the Invention

A problem faced by swimming pool owners with limited time to maintain their pools is that of collecting and removing floating leaves and other debris from the pool surface. A number of pool skimming devices designed to address this problem have been proposed and are in use with greater or lesser degrees of success. However, one of the main drawbacks experienced with the majority of the known skimming devices is the necessity for them to be fixed to the wall of the swimming pool. This generally requires holes to be drilled into the wall, often below the water level. This in turn necessitates at least partial emptying of the pool with a good deal of inconvenience and wastage of water.

The specification of South African patent 95/3297 describes a pool skimming device which does not require holes to be drilled in the wall of the swimming pool. Skimming devices of the type described in the specification of this patent have been found to operate quite well in practice. It is nevertheless thought that a simpler design and more efficient skimming of leaves and other floating debris is possible.

SUMMARY OF THE INVENTION

According to one aspect of the present invention, there is provided a swimming pool skimming device comprising a conduit, a connector for connecting a first end of the conduit to a return flow inlet of a swimming pool, a trap support unit to which the other, second end of the conduit is connectable, and a porous trap which is releasably supportable by the trap support unit with the second end of the conduit spaced apart from and aimed at the trap, the trap support unit being buoyant in water to support the second end of the conduit and the trap adjacent the surface of water in the swimming pool, whereby, in use, a return water flow from the return flow inlet passes through the conduit and is directed by the second end thereof, through water at the surface of the pool, towards the trap with the result that floating matter at the surface is entrained in the flow and directed into the trap.

Preferably, the trap support unit includes a shroud extending at least partially beneath the second end of the conduit. Conveniently also, the trap support unit comprises a retaining structure for retaining the trap releasably and float means carried by the retaining structure. In the preferred construction, the shroud extends from the retaining structure to a position beneath the second end of the conduit. The float means may comprise a hollow float housing accommodating a buoyant material. The retaining structure, shroud and float housing are preferably of one-piece moulded plastics construction.

The preferred connector comprises a tubular member attached at one end to the first end of the conduit and carrying at the other end a tapered end piece a resiliently deformable sleeve located slidably on the tubular member, and actuating means operable, with the end piece inserted into the return flow port, to slide the sleeve over the tapered end piece thereby to expand the sleeve radially into sealing engagement with the port. The tubular member typically has an externally threaded portion and the actuating means comprises a threaded collar on the threaded portion of the tubular member behind the sleeve and a washer which is located slidably on the tubular member between the collar and the sleeve and which is arranged to abut the wall of the swimming pool about the port when the end piece is inserted into the port, whereby the collar can be screwed along the threaded portion to drive the washer along the tubular member and hence to force the sleeve to slide over the tapered end piece.

DETAILED DESCRIPTION OF A PREFERRED EXEMPLARY EMBODIMENT

Figure 1:
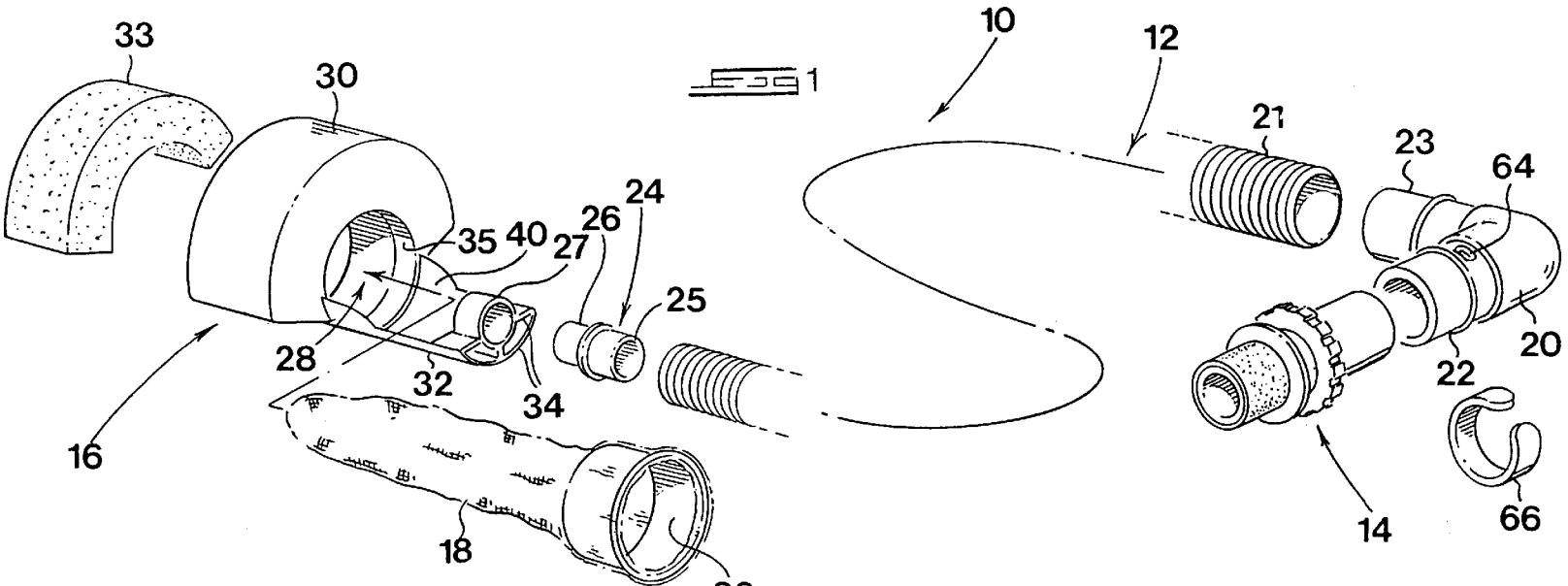
FIG. 1 shows an exploded perspective view of a swimming pool skimming device according to this invention.

In FIG. 1, the numeral 10 generally indicates a swimming pool skimming device according to this invention. As its main components, the device 10 includes a conduit 12, a connector 14, a trap support unit 16 and a porous trap 18.

The conduit 12 includes a 90° elbow 20, a length of flexible hose 21 and a connector member 24. The connector 14 is a friction fit on one limb 22 of the elbow 20 and the hose 21 is a friction fit on the other limb 23 thereof. The connector member 24 has a first spigot portion 25 which is a friction fit in the opposite end of the hose and a second spigot portion 26 which is a friction fit in an annular retainer 27 forming part of the trap support unit 16. The trap support unit 16 includes an annular retaining structure 28 on which is mounted a float housing 30. Extending from a lower extremity of the retaining structure 28 is a shroud 32 of part-cylindrical shape. The shroud extends beneath the retainer 27 with the retainer and hence the end of the hose 21 elevated above the shroud by support elements 34.

The retaining structure 28, float housing 30, shroud 32, support elements 34 and annular retainer 27 are formed integrally as a one-piece molding of a suitable, preferably UV-resistant plastics material. The float housing 30 is hollow and accommodates a float 33 which is a volume of buoyant, flexible foamed plastics material.

Figure 2:
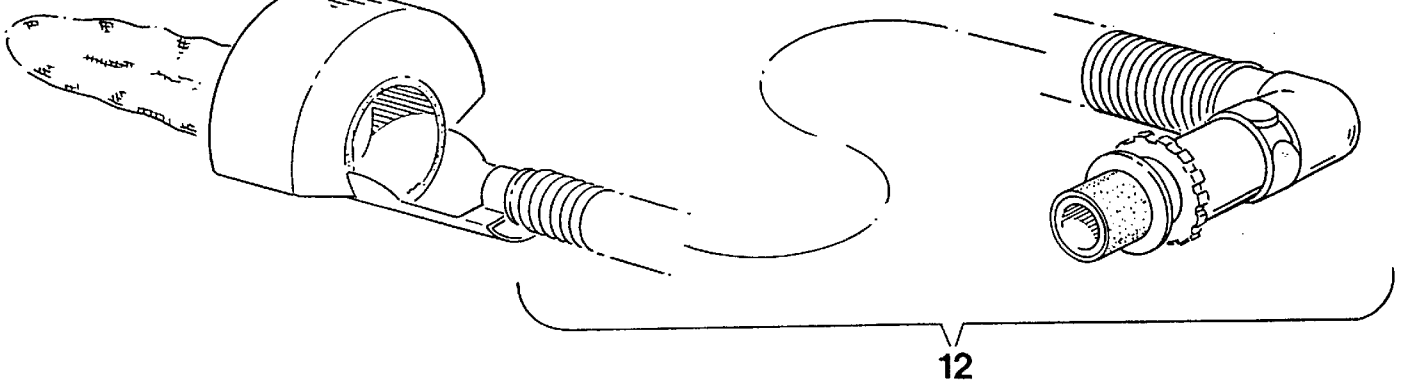
FIG. 2 shows an assembled perspective view of the device.
Figure 3:
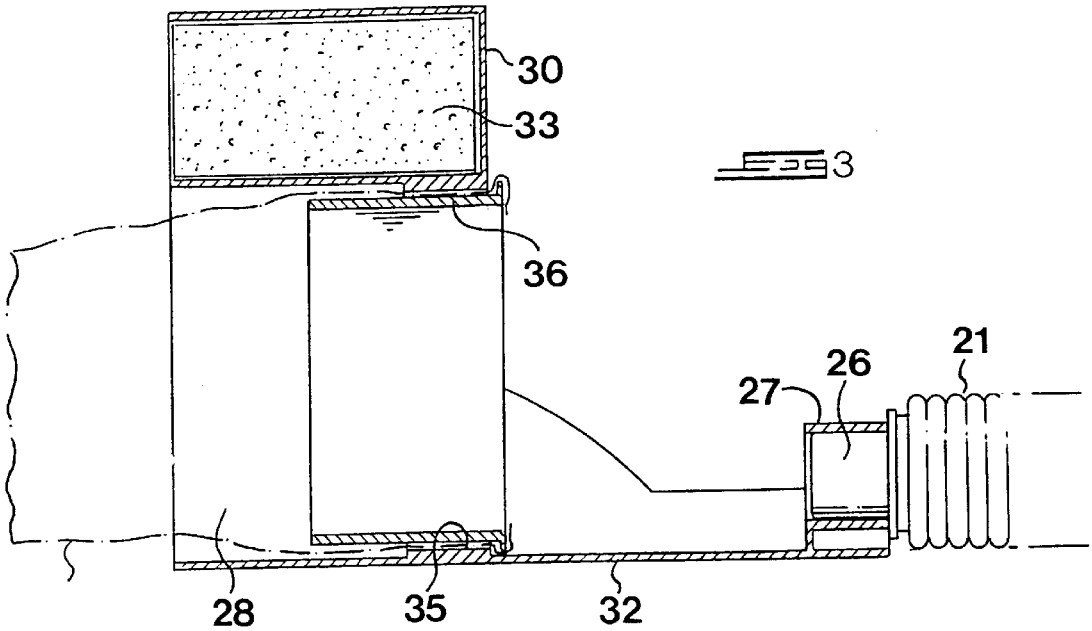
FIG. 3 shows a cross-section at the line 3—3 in FIG. 2.

The internal surface 35 of the retaining structure 28 has a slight taper. A complemental taper is provided externally on a ring 36 which is located in the open mouth of the porous trap 18. The trap 18 is made of a flexible net material with a small aperture size. During assembly, the mouth of the trap 18 is located about the ring 36 and the ring is then slipped into the retaining structure 28, in the direction of the arrow 40 in FIG. 1, until there is fictional engagement between the opposing taper surfaces. As seen in FIG. 2, the trap 18 then extends through and beyond the retaining structure 28.

Figure 4A:
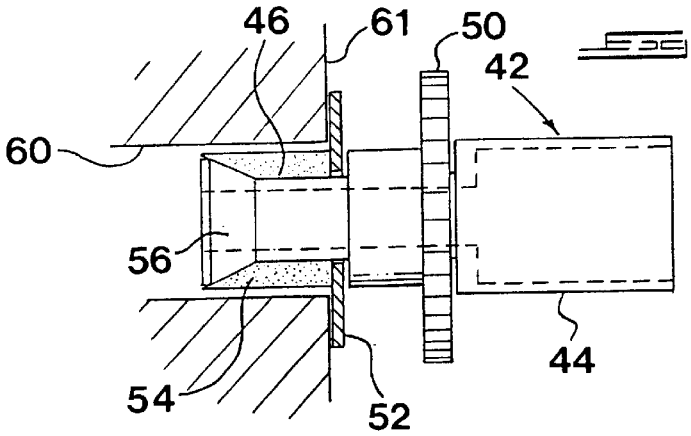
FIGS. 4A and 4B illustrate the operation of the connector used to connect the device to the return flow inlet port of a swimming pool.
Figure 4B:
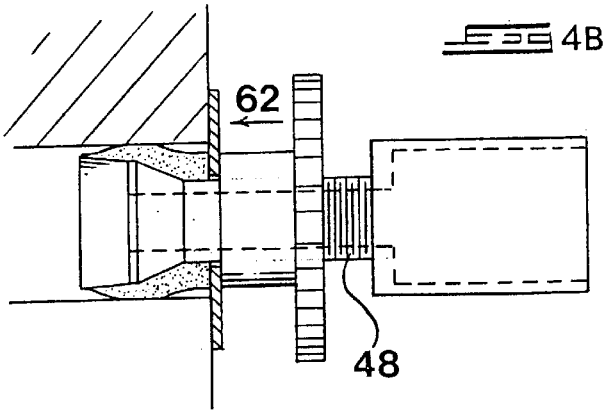

Referring to FIGS. 4A and 4B, the connector 14 includes a tubular member 42 having larger and smaller diameter tubular parts 44 and 46 respectively with an external thread 48 formed on the smaller diameter part 46. The connector 14 also includes an internally threaded collar 50, a washer 52, a resiliently flexible, tubular sleeve 54 and a frusta-conical end piece 56. In the assembled connector, the end piece 56 is connected by adhesive, welding or any other suitable means to the end of the part 46 with the collar 50 threaded onto the thread 48, the washer 52 located slidably on the part 46 and the sleeve 54 located partially over the part 46 and partially over the end piece. It will be noted that inner surface of the sleeve 54 is tapered at one end to match the taper of the end piece.

With the exception of the sleeve 54, all components of the connector 14 are molded in a rigid or semi-rigid grade of plastics material. The limb 22 of the elbow 20 is a tight friction fit in the part 44 of the tubular member 42.

The assembled swimming pool skimming device 10, as shown in FIG. 2, is installed in a swimming pool by inserting the end of the connector 14, i.e. the components 56, 54 and the relevant portion of the part 44, into the submerged return flow inlet port 60 in a side 61 of the pool until the washer 52 abuts the side of the pool about the inlet port, as shown in FIG. 4A. In situations where the standard return flow inlet is provided with an aimflow unit, this must initially be removed. The collar 50 is screwed in the direction 62 on the thread 48 to drive the washer 52 and sleeve 54 in the same direction. The sleeve 54 is pushed over the tapered portion of the end piece 56 which expands it radially into sealing contact with the interior of the return flow port 60 as shown in FIG. 4B. The resilient nature of the sleeve ensures that a good seal is obtained. This is enhanced by the fact that the washer 52 is pressed against the side of the swimming pool around the port 60.

The installation of the device 10 is such that the hose 21 extends alongside and parallel to the side 61 of the swimming pool in which the return flow inlet is situated. The buoyancy of the float housing 36 and float 33 is such that the trap support unit 16 floats at the surface of water in the swimming pool, typically with the discharge end of the hose 21 and the trap 18 partially submerged.

As is conventional, filtered return water is pumped back into the swimming pool through the port 60 from the pump and filtration unit (not illustrated).

With the device 10 installed as described above, the water flows through the connector 14, elbow 20 and the hose 21 which directs the flow into the trap 18. Surrounding surface water is entrained by the flow and is likewise directed towards the trap. Floating debris in the surrounding surface water, including leaves, is also entrained in the flow and is directed into the trap where it is captured as the water flows through the net apertures. The device 10 may be arranged to set up a swirling motion in the pool with leaves being drawn to the sides and swept around the pool for eventual capture in the trap 18.

When the trap 18 is full or when water flow through the trap 18 is excessively impeded by captured leaves and other debris, it is a simple matter to withdraw the ring 36 from the annular structure 28 and thereafter detach and empty the trap and replace it. The trap 18 can also be replaced entirely in the event of excessive wear.

A feature of the illustrated device 10 is the fact that the shroud 32 extends beneath the end of the hose. Thus, water located beneath the surface, which does not carry floating debris, will not generally be drawn into the flow exiting the hose. This in turn means that substantially the full entrainment effect is applied to surrounding surface water which carries the floating debris.

Another feature of the invention as exemplified above is the nature of the connector 14 which can operate successfully with a wide variety of port diameters.

In the illustrated embodiment, there is a pair of diametrically opposed apertures 64 in the limb 22 of the elbow 20. There is also a part-circular, resiliently flexible closure member 66 which can be rotated on the limb 22 to cover or uncover one or other of the apertures 64. By varying the position of the closure member on the limb 22, and hence the degree to which an aperture is covered, it is possible to vary the amount of surrounding pool water which is drawn into the conduit 12, and hence the force of the flow which exits from the end of the hose during operation. Thus, it is possible by this means to vary the performance of the surface skimming operation.

Yet another advantageous feature of the invention as exemplified above is the simplicity, of the components and, in particular, the trap support unit. As stated above, this unit is manufactured as a one-piece, molding with attendant cost savings and avoidance of assembly complications.

What is claimed is:

1. A swimming pool skimming device comprising a conduit, a connector for connecting a first end of the conduit to a return flow inlet of a swimming pool, a trap support unit to which the other, second end of the conduit is connectable, and a porous trap which is releasably supportable by the trap support unit with the second end of the conduit spaced apart from and aimed at the trap, and a shroud extending from the trap support unit, the trap support unit being buoyant in water to support the second end of the conduit and the trap at least partially submerged in surface water of the swimming pool with the second end of the conduit oriented laterally through the surface water towards the trap and with the shroud extending laterally from the trap support unit to a position beneath the second end of the conduit, whereby in use return water from the return flow inlet passes through the conduit and is directed by the second end of the conduit, in a laterally oriented flow through the surface water towards the trap with the result that surface water containing floating matter therein is entrained laterally into the flow and is directed into the trap for capture therein, the shroud serving to reduce entrainment of sub-surface water from beneath the second end of the conduit.

2. A swimming pool skimming device in accordance with claim 1 wherein the trap support unit includes a retaining structure for retaining the trap releasably and float means carried by the retaining structure.

3. A swimming pool skimming device in accordance with claim 2 wherein the float means comprises a hollow float housing accommodating a buoyant material.

4. A swimming pool skimming device in accordance with claim 3 wherein the retaining structure, shroud and float housing are of one-piece molded plastics construction.

5. A swimming pool skimming device in accordance with claim 1 wherein the connector comprises a tubular member attached at one end to the first end of the conduit and carrying at the other end a tapered end piece, a resiliently deformable sleeve located slidably on the tubular member, and actuating means operable, with the end piece inserted into the return flow port, to slide the sleeve over the tapered end piece thereby to expand the sleeve radially into sealing engagement with the port.

6. A swimming pool skimming device in accordance with claim 5 wherein the tubular member has an externally threaded portion and the actuating means comprises a threaded collar on the threaded portion of the tubular member behind the sleeve and a washer which is located slidably on the tubular member between the collar and the sleeve and which is arranged to abut the wall of the swimming pool about the port when the end piece is inserted into the port, whereby the collar can be screwed along the threaded portion to drive the washer along the tubular member and hence to force the sleeve to slide over the tapered end piece.

* * * * *